United States Patent [19]

Nelson

[11] 4,068,650

[45] * Jan. 17, 1978

[54] FIREPLACE HEATING CHANNEL

[76] Inventor: Clifford H. Nelson, 9 Merry Point Terrace, Newport News, Va. 23606

[ * ] Notice: The portion of the term of this patent subsequent to July 29, 1992, has been disclaimed.

[21] Appl. No.: 716,595

[22] Filed: Aug. 23, 1976

Related U.S. Application Data

[63] Continuation-in-part of Ser. No. 641,725, Dec. 18, 1975, Pat. No. 3,995,611.

[51] Int. Cl.[2] ..... F24B 7/04

[52] U.S. Cl. ..... 126/121; 126/140

[58] Field of Search ..... 126/121, 140, 128, 129, 126/130, 131, 138; 237/51

[56] References Cited

U.S. PATENT DOCUMENTS

| | | | |
|---|---|---|---|
| 3,896,785 | 7/1975 | Nelson | 126/129 |
| 3,901,212 | 8/1975 | Stites | 126/121 |
| 3,913,558 | 10/1975 | Caldwell | 126/140 |
| 3,965,886 | 6/1976 | Nelson | 126/121 |

FOREIGN PATENT DOCUMENTS

| | | | |
|---|---|---|---|
| 1,095,644 | 12/1967 | United Kingdom | 126/121 |

*Primary Examiner*—John J. Camby
*Assistant Examiner*—Larry I. Schwartz

[57] ABSTRACT

This invention is designed to provide a multiple increase in thermal efficiency of an existing conventional fireplace. The device consists of a hollow metal air conveying channel which is designed to fit closely against the inside walls of an existing fireplace without requiring structural modification for installation. When a fire is burning in the fireplace all the exposed surfaces of the air channel become heated. The internal blower and baffle system then direct the entering cool room air to make two horizontal passes through the heated air channel before returning to the room as hot air.

To further increase heating efficiency of the air conveying channel, a flame guide radiation reflector vane connects the upper inside surfaces of the two forward facing arms of the channel. This radiation reflector vane is V-shaped in cross section with a front vertical surface that fits under the fireplace arch and a bottom surface that slants rearward and upward to guide incoming air more effectively into the fire combustion zone. This bottom surface is backed with insulation so radiant heat from the fire is not lost up the chimney throat but instead is used to raise the temperature of the air channel by means of reradiation of thermal energy from this high temperature bottom surface.

Additional improvement in overall thermal performance is secured through using a metal front closure for the fireplace. This front closure is designed to have two pairs of hinged doors with transparent panels and yield several important advantages, such as, control of air input to fire, maximum safety during untended periods of operation and significantly improved efficiency.

The whole assembly is readily insertible in an existing fireplace and does not interfere with its normal functioning. Therefore, the device is compatible with a broad range of fireplace sizes and types.

6 Claims, 6 Drawing Figures

FIREPLACE HEATING CHANNEL

CROSS REFERENCE TO RELATED APPLICATIONS

This application pertains to improvements to my U.S. Pat. No. 3,896,785 dated July 29, 1975 and U.S. Pat. No. 3,965,886 dated June 29, 1976 both issued to Clifford H. Nelson. In addition this application is presented as a continuation in part to my application Ser. No. 641,725 filed on Dec. 18, 1975 now U.S. Pat. No. 3,995,611.

DESCRIPTION OF PRIOR ART

Currently on the market are various devices that are placed inside a conventional fireplace to provide additional heat to a room. These designs are generally based on circulating room air through the device. Direction of this room air flow is mainly vertical. In a distinct departure from prior art this invention employs multiple passes of air flow to heat room air. In addition to being a more efficient extractor of heat from the fireplace fuel, this invention has a minimum impact on the original appearance and decor of the fireplace. Novel features that contribute to its high performance include an air conveying channel that fits against the inside walls of the fireplace and containing a blower and horizontal baffling, a flame guide radiation reflector vane, a radiation reflector side panel, and an attached front closure with two pairs of folding doors with transparent panels. These novel features combine to reduce air and heat losses to the chimney, increase transfer of heat to the subject device, and when compared to prior art this invention further conserves the use of shortage fuels and reduces the use of electric power required for operation.

BACKGROUND OF THE INVENTION

Our nation is currently faced with a projected shortage of energy derived from gas and fuel oil. This invention is directed toward reducing the use of these shortage fuels for heating individual houses.

Many American houses have fireplaces that could burn alternate fuels such as wood, coal, and other combustibles, but because the efficiency of the conventional fireplace is low, use as an alternate heating source is marginal.

The Fireplace Heating Channel meets this need and transforms what has traditionally been primarily a decorative feature of the house into a more efficient generator of useful heat.

SUMMARY OF THE INVENTION

The Fireplace Heating Channel consists of a metal air conveying channel designed to fit closely against the inside walls of an existing fireplace and containing a blower and horizontal baffling so as to efficiently heat room air by directing it through multiple horizontal passages of the heated air channel before returning it back into room. Increased performance is obtained through the use of a unique flame guide radiation reflector vane which transfers the radiant energy, normally lost to the chimney, back to the room air conveying channel where it is then transformed into increased useful room heat from the fireplace. Another novel feature is the use of an attached fireplace front closure that has two pairs of folding doors with transparent panels which provide several advantages, including greater overall thermal efficiency by reducing excess air losses to the chimney and maximum safety during untended periods of operation.

The Fireplace Heating Channel is readily insertible in an existing fireplace and does not interfere with its normal functioning and is compatible with a wide range of fireplace sizes and shapes.

DETAILED DESCRIPTION OF THE INVENTION

Figure 1:
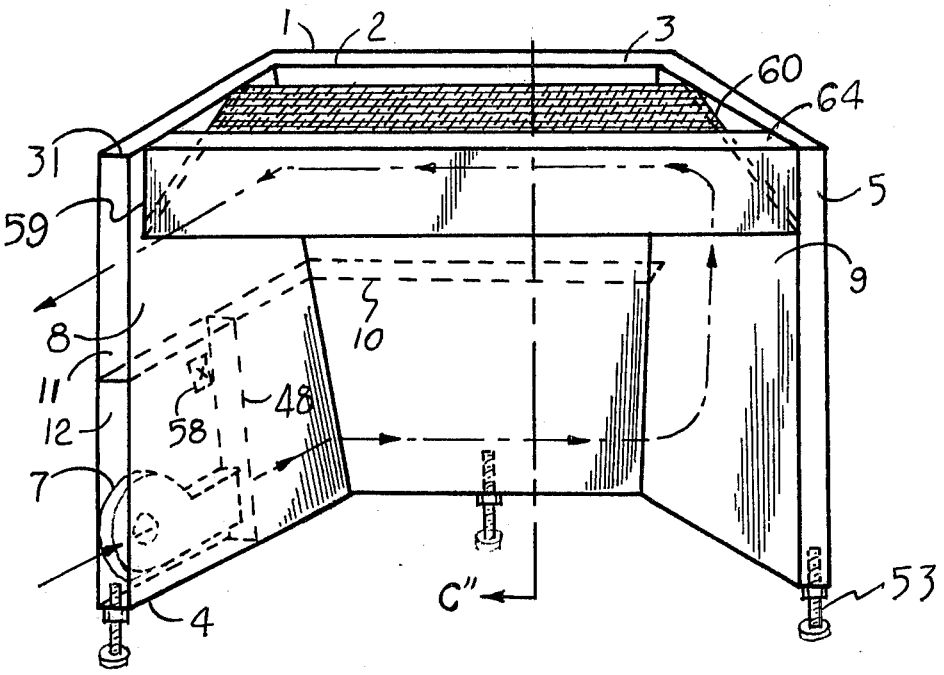
FIG. 1 is a schematic drawing of the Fireplace Heating Channel inner assembly illustrating the three sided air conveying channel with internally mounted air blower and horizontal baffling, the thermostatic blower control, a flame guide radiation reflector vane, and vertically adjustable legs. The front closure is not shown attached in this drawing to achieve greater clarity of the functional operation and description.

FIG. 1 is a schematic drawing of an inner Fireplace Heating Channel assembly consisting of a three sided air conveying channel 31 equipped with a flame guide radiation reflector vane 59, a baffle 10, partition 48, air blower 7, thermostatic blower control 58 and adjustable legs 53, designed to efficiently heat circulating room air. The three sided air conveying channel 31 has two forward facing channel arms 8 and 9 attached to the rear air channel 2 and is designed to fit against the three interior walls of an existing fireplace without requiring structural modification to the fireplace. The two forward facing arms 8 and 9 and the rear air channel 2 are fastened together at the edges to form a continuous air conveying channel 31. Air conveying channel 31 has adjoining vertical sides 8, 2 and 9 exposed to the fire and an opposing vertical side 1 which fits against the inside walls of an existing fireplace. The air conveying channel has top 3 and bottom 4 sides and an end cap 5 so as to form a continuous air conveying channel that is designed to efficiently heat circulating room air. Baffle 10 divides the forward facing channel arm 8 and the rear or center channel 2 into an upper 11 and lower 12 room air passage. Air blower 7 is attached to partition 48 and induces room air to flow into the lower air passage 12 and subsequently guides the room air in following the route through the air channel 31 indicated by the dot-dash lines. Room air flows through the lower passage 12 and turns upward and reverses flow in forward facing channel arm 9 and then follows the upper passage 11 to exit back into the room. The flame guide radiation reflector vane 59 is fastened to the upper front inside portion of the two forward facing arms 8 and 9 and placed forward enough to leave a vent in the rear for the exhaust of fire gases to the chimney. The cross section is basically V-shaped and is shown more clearly by cross section C″ in FIG. 2, with a vertical front side and a bottom surface which slants rearward and upward to properly control the flow of air to the fire, in addition a small horizontal top flange 64 is provided which contacts the fireplace arch to seal against excess room air flow over the top of the flame guide radiation reflector vane 59. The upper side of the bottom metal surface of the flame guide radiation reflector vane 59 is covered with heat insulation 60 to minimize loss of radiant heat energy up the chimney. Accordingly the bottom metal surface absorbs heat energy from the fire and the resulting rise in temperature causes the bottom metal surface to reradiate heat energy to all the exposed surfaces of the inner fireplace heating channel 31. This flame guide radiation reflector vane is simpler and can achieve a higher overall efficiency than the flame guide vanes described in my previous patents and therefore represents an improvement in the state of the art. Vertically adjustable legs 53 are used to move the entire assembly 31 upward to bring horizontal flange 64 in contact with the fireplace arch during installation. Thermostatic blower control 58 is located inside the air blower 7 compartment. The function of the thermostatic blower control 58 is to automatically turn on the air blower 7 when the surface of the forward facing channel arm 8, exposed to the fire, reaches the proper temperature and to turn off the air blower 7 when the temperature of the exposed surface falls to a suitable level. Thus, the air blower 7 starts up shortly after the fire has been kindled and will automatically stop when the fire goes out so as to avoid excessive running of the air blower 7 and by this means conserve the use of electrical energy. The outer front closure that is attachable to the inner Fireplace Heating Channel assembly of FIG. 1 is shown by cross section of the complete assembly in FIG. 2.

The Fireplace Heating Channel inner assembly comprised primarily of a three sided air channel in combination with a flame guide radiation reflector vane, single blower, thermostatic blower control and vertically adjustable legs is designed to significantly increase the room heating efficiency of conventional fireplaces, thereby achieving multiple advancements over prior art, including, (a) uniquely designed flame guide radiation reflector vane that forms an upward converging passageway to increase the convective heat transfer from ascending fire gases to the upper portion of the center panel of the air channel and also absorbs radiation emanating from the fire that would ordinarily be lost up the chimney structure and efficiently reradiates this energy to all the other exposed surfaces of the inner assembly to increase the heating rate of the circulating room air, (b) as the flame guide radiation reflector vane extends downward below the fireplace arch, the room air is forced to enter the fire more nearly at the combustion level where it is needed and excess air flow to the fire is thus reduced to increase the overall heat recovery from the fire, (c) the horizontal passes of circulating room air through the air channel represent an advancement over prior art, (d) with horizontal baffling only one room air blower is required for air circulation, as opposed to the two normally used in prior art, (e) thermostatic blower motor control eliminates excessive and unnecessary operation of the blower motor, resulting in conservation and reduced use of electrical power for operating the fireplace.

Figure 2:
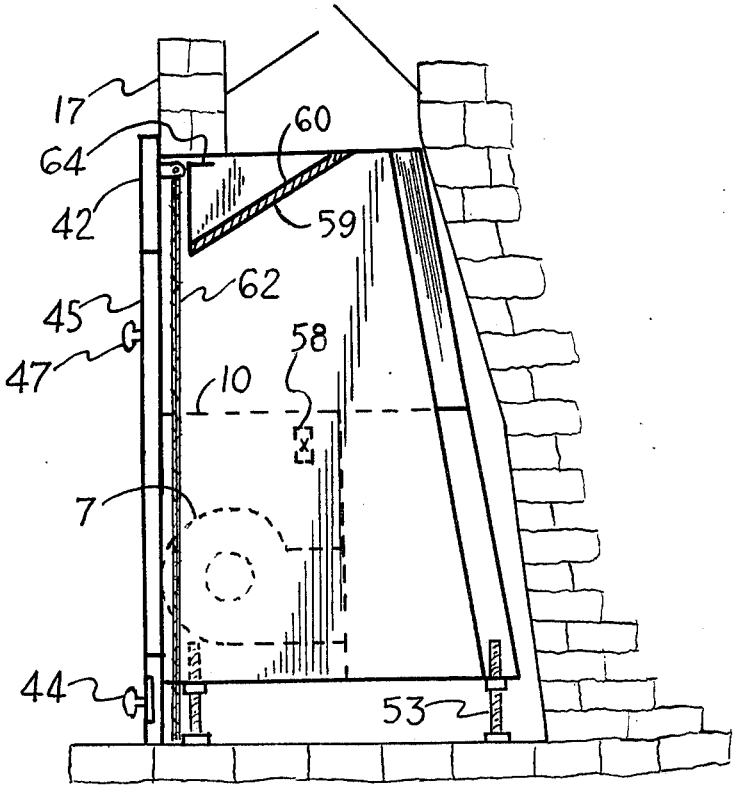
FIG. 2 is a schematic drawing of cross section C″ of FIG. 1, C′ of FIG. 3 and C—C of FIG. 4 and illustrates the cross section of a typical Fireplace Heating Channel inner assembly attached to the outer front closure. The drawing includes a sectional view of the air conveying channel, air blower and horizontal baffling, thermostatic blower control, flame guide radiation reflector vane, adjustable legs, horizontally sliding spark screen and the front closure with a front facing covering the fireplace and containing two pairs of hinged doors, an open mesh screen covering the inlet and outlet vents for circulating room air, and a fire control damper.
Figure 3:
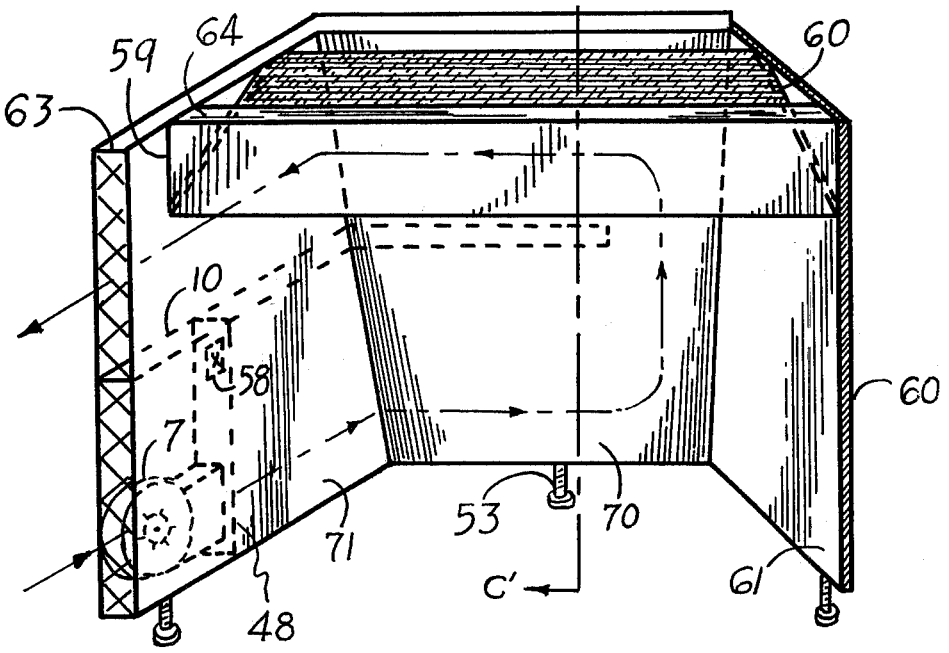
FIG. 3 is a schematic drawing of a two sided air conveying channel equipped with an internally mounted air blower and horizontal baffle system, a thermostatic blower control, a flame guide radiation reflector vane, a radiation reflector side panel and adjustable legs.
Figure 4:
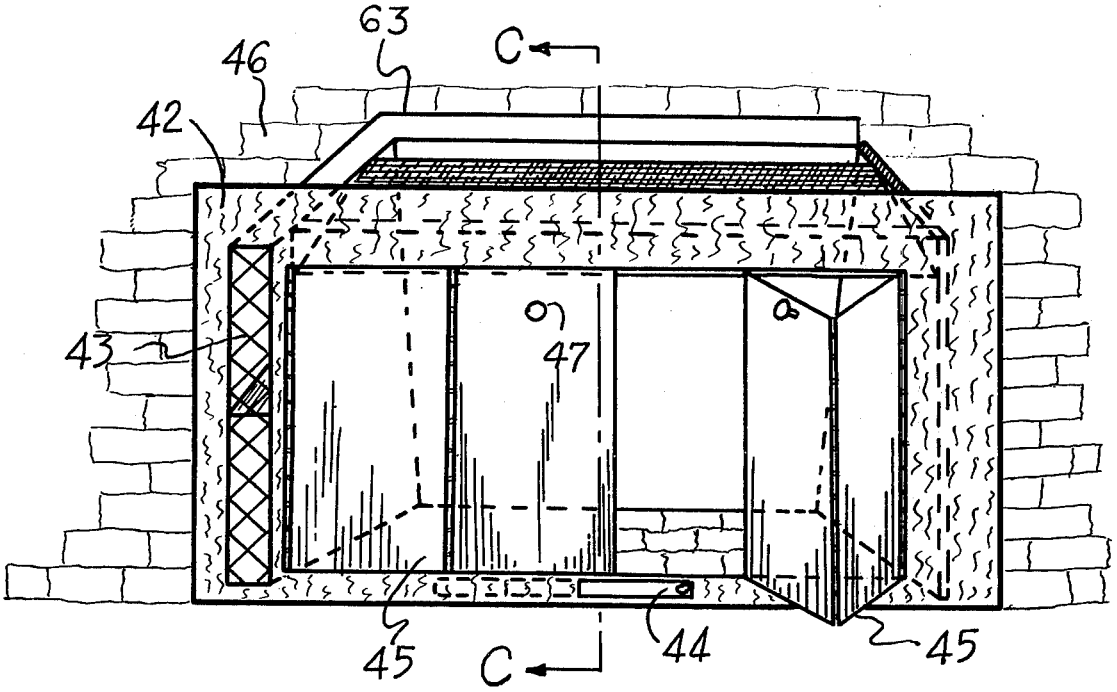
FIG. 4 is a schematic drawing of the front view of the Fireplace Heating Channel with the front closure attached to a typical inner assembly.

FIG. 2 is a schematic drawing of the cross section C″ of FIG. 1, C′ of FIG. 3 and C—C of FIG. 4. A typical cross section of an inner Fireplace Heating Channel assembly 63 is shown installed inside of an existing brick fireplace 17 and attached to an outer front closure assembly 42. A forward facing arm of the air conveying channel is shown containing an air blower 7 and baffle 10. The automatic thermostatic blower control 58 is located inside the forward facing arm in the blower compartment. The adjustable legs 53 are used for vertically positioning at time of installation. The outer front closure assembly has a front facing 42 that covers the front wall 17 of the fireplace and rests on the hearth floor to effect an air seal against the flow of excess room air. The front facing has two pairs of folding doors 45 which are opened and closed by heat insulated handles 47. When the doors 45 are closed, the air input to fire is controlled by damper 44. A horizontally sliding spark screen 62 is used to guard against flying sparks entering the room when doors 45 are open. These screens slide horizontally to provide access to the fire. The flame guide radiation reflector vane 59 is shown in cross section being fastened to the inside surface of the forward facing arms and at the top of the air conveying channel. The cross sectional form is primarily V-shaped with a front vertical side, a bottom surface which slants upward and rearward to guide the incoming air into the fire and against the rear air channel, in addition a small horizontal flange 64 is used to contact the fireplace arch to seal against room air flow over the top of the flame guide radiation reflector vane 59. The upper side of the bottom surface of the flame guide radiation reflector vane 59 is covered with heat insulation 60 to minimize loss of radiant heat energy up the chimney. Accordingly the bottom metal surface absorbs heat from the fire and the resulting rise in temperature causes the bottom surface to efficiently reradiate heat energy to all the exposed surfaces of the inner Fireplace Heating Channel assembly 63.

FIG. 3 is a schematic drawing of a simplified inner Fireplace Heating Channel assembly 63 consisting of a two sided air conveying channel with a forward facing arm 71 and a rear or center channel 70 attached thereto and equipped with a radiation reflector side panel 61 and a flame guide radiation reflector vane 59. The entire assembly 63 is designed to fit against the interior walls of an existing fireplace without requiring modification of the fireplace structure. An air blower 7 mounted on partition 48 is located inside the lower part of forward facing arm 71 and by means of baffle 10 shown by dotted lines in FIG. 3 the room air is directed to follow the route indicated by the dot-dash lines in the two sided air channel. Room air enters the lower part of the forward facing channel arm 71 and passes through the blower 7 and flows through the lower passage of the center channel 70 and then turns upward and returns along the upper passage and exits back into the room. The second forward facing arm is formed by a radiation reflector side panel 61 which is attached to the right hand side of the center air channel 70. This radiation reflector side panel 61 has a backing of insulation 60 to prevent loss of heat energy to the brickwork immediately behind the side panel 61. Thus, the exposed metal surface of the radiation reflector side panel 61 absorbs the heat energy falling upon it which raises its temperature and causes it to reradiate heat energy into the room, back into the fire and to all other exposed surfaces of the Fireplace Heating Channel. The flame guide radiation reflector vane 59 is fastened to the upper inside surface of the forward facing arms 71 and 61 and placed forward enough to leave a vent for hot fire gases in the rear. The cross section is shown more clearly in FIG. 2 being basically V-shaped with a vertical front side and a bottom surface which slants upward and rearward to properly control the flow of air to the fire, in addition it has a small horizontal flange which by means of the vertically adjustable legs 53 can be brought in contact with the fireplace arch at the time of installation of the entire assembly 63 into an existing fireplace. An automatic thermostatic blower control is located inside the blower compartment on the fire side surface of the forward facing arm 71 where it responds to the temperature variations such that it turns the blower motor on shortly after the fire has been kindled and turns the blower off automatically when the fire has gone out, thus avoiding excessive running of the blower. All of the advantages claimed for the configuration in FIG. 1, cited (a) through (e) apply equally well to the configuration shown in FIG. 3.

Figure 5:
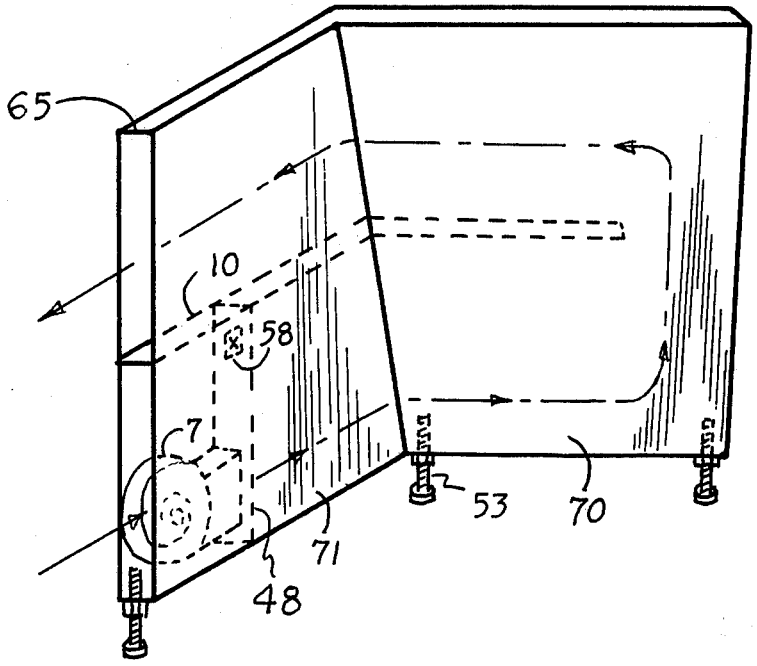
FIG. 5 is a schematic drawing of a simplified inner assembly of the Fireplace Heating Channel including a two arm air conveying channel with air blower, horizontal baffle, thermostatic blower control, and adjustable legs.

FIG. 4 is a schematic drawing of the whole assembly of the Fireplace Heating Channel which includes a typical inner fireplace heating assembly 63 attached to the outer front closure assembly 42. The inner assembly 63 shown in FIG. 4 is only illustrative as all inner assemblies shown in FIG. 1, 3 and 5 are all designed to be adaptable to this outer front closure 42 and individually form a complete whole assembly when attached to the outer front closure assembly 42. The front closure has a front facing that surrounds the fireplace opening and overlaps onto the brick front 46 and rests on the fireplace hearth. The open mesh grill 43 covers the circulating room air passages for inlet and venting. Two pairs of hinged doors 45 are shown with the left hand pair in the closed position and the right ones in the partially open position. The doors 45 can be fitted with metal panels or equipped with heat resistant transparent material panels. Handles 47 are heat insulated and are used to facilitate opening and closing the doors 45. When the doors 45 are in the closed position, a fire damper 44 permits adjustment of air to the fire. The fire damper 44 slides horizontally, being illustrated in the right hand position. A horizontally sliding spark screen 62 is shown, in the interest of clarity, by cross section C-C in FIG. 2 and is located between the front facing 42 and the inner Fireplace Heating Channel assembly 63. When the doors 45 are open the spark screen 62 may be pushed aside for full access to the fire.

With the doors open, all the unique design features of the inner Fireplace Heating Channel 63 assembly apply, as specified in the detailed description of FIG. 1 by cited examples (a) thru (e) and with the doors 45 closed on this complete free standing assembly many additional novel design features and advantages become available, such as (f) the most cogent advantage is the sharp rise in overall efficiency of operation. This is obtained through control of room air flow into the fire. As the Fireplace Heating Channel is inserted into a fireplace and the front closure is brought against the outer facing of the fireplace, only very small openings or leakage areas exist to allow excess or uncontrolled air into the fire. The inlet fire damper 44 can then be adjusted to obtain the optimum fire combustion rate. With the doors closed on the Fireplace Heating Channel, the operation is similar to that of a conventional house furnace having a closed firebox with damper control of air input and with room air being heated by circulating separately around the outside of the firebox. Here then is the explanation for the sharp rise in thermal efficiency that can be achieved with the hinged doors 45 closed, (g) the door closure capability of the heating channel assembly provides for greater safety of operation, as when a large fire is burning and because of some unplanned event it must be quickly left untended, the doors can be closed for maximum security during the period of absence, (h) the control of air input make it possible to keep the fireplace operating through the night. A substantial amount of fuel can be placed in the fireplace at bedtime and with the fire damper almost closed the fire combustion rate is so controlled that a very long time of burning can be achieved similar to the current practice of night operation of a coal fired furnace, (i) the householder may also desire to secure maximum efficiency of operation by keeping the doors closed and still enjoy the firelight through the transparent door closure panels and to additionally have the satisfaction of greatly extending the time period between refuelings of the fire.

FIG. 5 is a schematic drawing of a simplified inner assembly of the Fireplace Heating Channel. The metal room air conveying channel 65 has two arms, consisting of a forward facing channel arm 71 that is joined to the rear or center channel 70. The assembly is designed to fit against two inside walls of an existing fireplace without requiring structural modification thereof. The baffle 10 divides the forward facing channel arm 71 and part of the center channel 70 into an upper and lower air passage. Air blower 7 is attached to partition 48 and draws room air into the lower passage of the forward facing channel arm 71 and directs it to follow the route indicated by the dot-dash line wherein the room air flows from the outlet of the blower along the lower passage until it nears the right end of the center channel arm 70 where it turns upward and reverses and flows back into the room along the upper passageway. The vertically adjustable legs 53 are used to bring the top forward portion of the forward facing arm 71 in direct contact with the fireplace arch at the time of installation. The thermostatic blower control 58 is located inside the air blower compartment 7, and mounted on the fireside surface of the forward facing channel arm 71 so as to be responsive to the heat emanating from the fire, thus the blower starts up shortly after the fire has been kindled and will automatically stop when the fire goes out so as to avoid excessive running of the air blower 7 and by this means conserve the use of electrical energy.

The design shown schematically in FIG. 5 was created to minimize cost of construction without sacrificing an acceptable level of performance, in order to promote extensive utilization of the Fireplace Heating Channel for the conservation of this nation's shortage fuels.

The uniqueness of this design is characterized by the simple two adjoining channel arms with multiple horizontal passages for heating air, the use of a single blower with automatic control and provided with vertically adjustable legs. Therefore, the invention illustrated in FIG. 5 represents an advancement over the state-of-art for its simplicity of construction and substantial overall thermal performance as compared to an existing brick and mortar fireplace.

Figure 6:
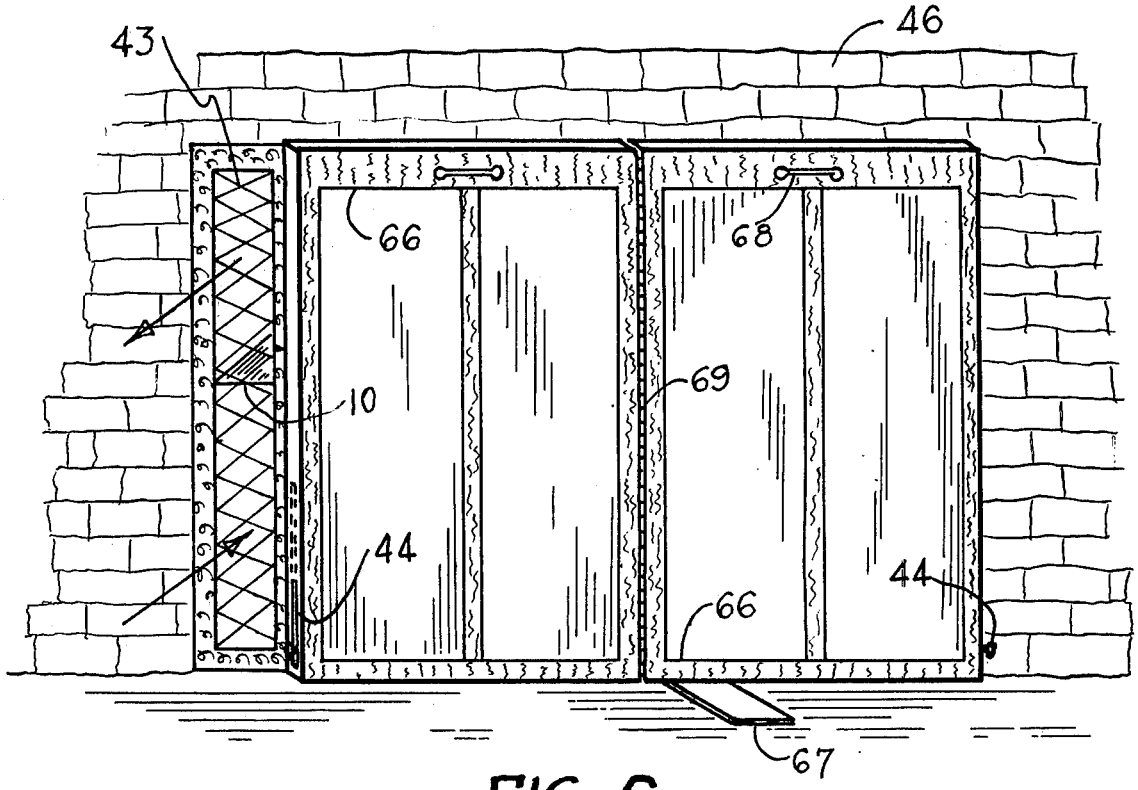
FIG. 6 is a schematic drawing of a folding front closure that is portable. The device has two halves that are hinged in the middle and equipped with panels and a support foot for vertical stability and fire control dampers.

FIG. 6 is a schematic drawing of a folding front closure 66 for a fireplace that is designed to be compatible with all the inner assemblies of the fireplace heating channels shown in FIGS. 1, 2, 3, and 5. The folding front closure 66 is shown in place against the inner edge of the open mesh grill 43 covering the room air passages for inlet and outlet of circulating room air and also against the front face 46 of the fireplace and resting on the hearth. The folding front closure consists of a front facing 66 that is divided into two halves which are fastened together by a vertical folding hinge 69. Each of these halves are equipped with panels that are of solid metal or heat resistant transparent material. Two heat insulated handles 68 are used to lift the folding front closure when removal, storage or installation is required. The hinge 69 is designed to permit folding the inner surfaces, which have been exposed to the fire, against one another to insure cleanliness during handling. Hinge 69 is also designed to prevent opening the doors beyond that required to open and fit snugly against the fireplace front 46 in order to prevent an inward collapse due to the suction force developed by the heated chimney gases. To hold the folding front closure securely in place when the fire is no longer burning a support foot 67 is located near the bottom center of the folding front closure, the support foot also provides vertical stability when the closure is folded for storage. Control of air flow into fire is secured by means of two air dampers 44 located on the outside edges of the folding front closure 66, the design being similar to the damper shown in FIG. 4 with control of air flow resulting from up and down sliding action. Although the folding front closure 66 may be used at any time, the prime function is to seal the fireplace opening when the fire is still burning, but must be left untended, such as occurs when the householer retires for the night. The extravagant loss of heat contained in the room air flowing up the chimney throughout the entire night or otherwise is eliminated with the folding front closure 66 in place against the fireplce opening and also the household is secure against dangerous sparks flying into the room and in addition the blower continues to bring heat into the room until the fire fuel is exhausted. In fact, all the cited advantages (f) thru (i) listed under FIG. 4 description, apply when the folding front closure 66 of FIG. 6 is in place against the fireplace front.

I claim:

1. A free standing fireplace heating channel comprised of a three sided hollow metal room air conveying channel equipped with an internal baffle to direct the flow of air, an internally mounted blower for forcing circulation of room air, a thermostatic blower control, a flame guide radiation reflector vane and vertically adjustable legs, the entire assembly being insertible in an existing fireplace without requiring modification to the structure thereof, said air conveying channel having a center channel joined with two forward facing channel arms and designed to fit against the three inside walls of an existing fireplace, said air conveying channel having adjoining walls exposed to the heat from the fire with corresponding rear walls spaced therefrom and connected by spacer means so as to form a continuous air channel for conveying room air to be heated by the fire, including baffle means, dividing said air channel into upper and lower portions, to direct the circulating room air to make multiple horizontal passes through said air conveying channel wherein air blower means is provided for forcing room air through said air conveying channel along its lower portion prior to existing back into a room through the upper portion thereof as useful heated air, a thermostatic blower control located inside one of said channel arms and mounted on the air channel wall exposed to the fire, said flame guide radiation reflector vane being symmetrically attached to the upper inside surfaces of said forward facing channel arms and having an approximately V-shaped crosssection with a vertical surface located under an existing fireplace arch and provided with a small top horizontal flange and an adjoining bottom surface slanting upward and rearward being positioned forward of the center air channel to provide suitable exit for the fire exhaust gases to the chimney, said bottom surface of said flame guide radiation reflector vane having a top covering of heat insulation preventing major loss of heat energy to an existing chimney, said vertically adjustable legs attached to the bottom of said air conveying channel providing means of moving the whole assembly upward to place said small top horizontal flange of the flame guide radiation reflector vane in direct contact with an existing fireplace arch during installation of the fireplace heating channel.

2. A free standing fireplace heating channel as defined in claim 1 and additionally including a front closure assembly comprised of a metal front facing, inlet and outlet openings for circulating room air, two pairs of hinged doors, a horizontally sliding spark screen and a fire control damper, whereby the said front closure is attached to the inner assembly of the fireplace heating channel and when the whole assembly is inserted into a fireplace the said front facing means overlaps the fireplace opening and contacts both the front wall and hearth thereby effecting a peripheral air seal around the fireplace opening, whereas an open mesh grill covering is provided on one side of the front facing to coincide with the circulating room air inlet and outlet openings of the inner assembly of the fireplace heating channel, whereby the said front facing has two pairs of hinged doors located in its center portion that can be folded to the sides to secure access to the fire or can be closed to prevent room air flow to the fire, said hinged doors having center panels that are of solid metal or of heat resistant transparent material, in addition a horizontally sliding spark screen is located just inside the said front facing to prevent hot embers entering the room when the hinged doors are open, said front facing also contains a fire control damper located just above the fireplace hearth which slides horizontally to adjust the flow of air admitted to the fire.

3. A free standing fireplace channel comprised of a two sided hollow metal air conveying channel with an internal baffle to direct the flow of air, an internally mounted blower for forcing circulation of room air, a thermostatic blower control, a radiation reflector side panel, a flame guide radiation reflector vane and vertically adjustable legs, the entire assembly being insertible in an existing fireplace without requiring modification to the structure of the fireplace, said air conveying channel having a center channel joined with a forward facing channel arm and designed to fit against two inside walls of an existing fireplace, said air conveying channel having adjoining walls exposed to the heat from the fire with corresponding rear walls spaced there from and connected by spacer means to form a suitable air channel for conveying room air to be heated by the fire, including baffle means, dividing said air channel into upper and lower portions, to direct circulating air to make multiple passes through said air conveying channel, wherein air blower means is provided for forcing room air through the said air conveying channel along its lower portion prior to exiting back into the room through the upper portion thereof as useful heated air, a thermostatic blower control is located inside the channel arm and mounted on the air conveying channel wall exposed to the fire so as to automatically turn the air blower on and off at predetermined temperature levels, said radiation reflector side panel being symmetrically attached to the opposite side of the center channel from the forward facing channel arm and provided with an insulation backing to prevent loss of heat energy to the existing fireplace brick, whereas said flame guide radiation reflector vane being symmetrically attached to the upper inside surfaces of the forward facing channel arm and the radiation reflector side panel and having an approximately V-shaped cross section with a vertical surface located under an existing fireplace arch and with a small top horizontal flange and an adjoining bottom surface slanting upward and rearward being positioned forward of the center air channel to provide a suitable exit for the exhaust gases to an existing chimney and said bottom surface of said flame guide radiation reflector vane having a top covering of heat insulation preventing loss of heat to an existing chimney, said vertically adjustable legs attached to the bottom of said air conveying channel to provide means of moving the whole assembly upward to place the said small top horizontal flange of flame guide radiation reflector vane in direct contact with an existing fireplace arch during installation of the fireplace heating channel.

4. A free standing fireplace heating channel as defined in claim 3 and additionally including a front closure assembly comprised of a metal front facing, inlet and outlet openings for circulating room air, two pairs of hinged doors, a horizontally sliding spark screen and a fire control damper, whereby the said front closure is attached to the inner assembly of the fireplace heating channel and when the whole assembly is inserted into a fireplace the said front facing means overlaps the fireplace opening and contacts both the front wall and hearth thereby effecting a peripheral air seal around the fireplace opening, whereas an open mesh grill covering is provided on one side of the front facing to coincide with the circulating room air inlet and outlet openings of the inner assembly of the fireplace heating channel, whereby the said front facing has two pairs of hinged doors located in its center portion that can be folded to the sides to secure access to the fire or can be closed to prevent room air flow to the fire, said hinged doors having center panels that are of solid metal or of heat resistant transparent material, in addition a horizontally sliding spark screen is located just inside the said front facing to prevent hot embers entering the room when the hinged doors are open, said front facing also contains a fire control damper located just above the fireplace hearth which slids horizontally to adjust the flow of air admitted to the fire.

5. A free standing fireplace heating channel comprised of a two sided hollow metal air conveying channel with an internal baffle to direct the flow of air, an internally mounted blower for forcing circulation of room air, a thermostatic blower control and vertically adjustable legs, the entire assembly being insertible in an existing fireplace without requiring modification to the fireplace structure, said air conveying channel having a center channel joined with a forward facing channel arm and designed to fit against two inside walls of an existing fireplace, said air conveying channel having adjoining walls exposed to the fire heat with corresponding rear walls spaced therefrom and connected top and bottom and on one end by means of spacers so as to form a suitable air channel for conveying room air to be heated by the fire, wherein baffle means, dividing said air channel into upper and lower portions, directs the circulating room air to make multiple horizontal passes through said air conveying channel, whereas air blower means is provided for forcing room air through the said air conveying channel along its lower portion prior to exiting back into a room through the upper portion thereof as useful heated air, a thermostatic blower control located inside the channel arm and mounted on the air conveying channel wall exposed to the fire so as to automatically turn air blower on and off at predetermined temperature levels, said vertically adjustable legs attached to the bottom of said air conveying channel providing means of moving the whole assembly upward to place the top of the forward facing arm in direct contact with an existing fireplace arch.

6. A free standing fireplace heating channel as defined in claim 5 and additionally including a front closure assembly comprised of a metal front facing, inlet and outlet openings for circulating room air, two pairs of hinged doors, a horizontally sliding spark screen and a fire control damper, whereby the said front closure is attached to the inner assembly of the fireplace heating channel and when the whole assembly is inserted into a fireplace the said front facing means overlaps the fireplace opening and contacts both the front wall and hearth effecting a peripheral air seal around the fireplace opening, whereas an open mesh grill covering is provided on one side of the front facing to coincide with the circulating room air inlet and outlet openings of the inner assembly of the fireplace heating channel, whereby the said front facing has two pairs of hinged doors located in its center portion that can be folded to the sides to secure access to the fire or can be closed to prevent room air flow to the fire, said hinged doors having center panels that are of solid metal or of heat resistant transparent material, in addition a horizontally sliding spark screen is located just inside the said front facing to prevent hot embers entering the room when the hinged doors are open, said front facing also contains a fire control damper located just above the fireplace hearth which slides horizontally to adjust the flow of air admitted to the fire.

* * * * *